US006935258B1

(12) United States Patent
Hagino

(10) Patent No.: US 6,935,258 B1
(45) Date of Patent: Aug. 30, 2005

(54) EMBROIDERING SYSTEM

(75) Inventor: Seiichiro Hagino, Chiryu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/854,233

(22) Filed: May 27, 2004

(30) Foreign Application Priority Data

Feb. 17, 2004 (JP) ..... 2004-040357

(51) Int. Cl.[7] ..... D05C 5/02
(52) U.S. Cl. ..... 112/102.5; 112/155; 112/273
(58) Field of Search ..... 112/102.5, 155, 112/470.06, 273; 700/138

(56) References Cited

U.S. PATENT DOCUMENTS 5,921,194 A * 7/1999 Komuro et al. ..... 112/470.01
6,123,037 A * 9/2000 Shimizu ..... 112/102.5

FOREIGN PATENT DOCUMENTS

JP 6-304372 11/1994

OTHER PUBLICATIONS

U.S. Appl. No. 10/831,154, filed Apr. 26, 2004, Hagino et al.
U.S. Appl. No. 10/854,233, filed May 27, 2004, Hagino.
U.S. Appl. No. 10/637,501, filed Aug. 11, 2003, Hagino et al.
U.S. Appl. No. 10/892,091, filed Jul. 16, 2004, Hagino et al.

* cited by examiner

*Primary Examiner*—Peter Nerbun
(74) *Attorney, Agent, or Firm*—Oblon, Spivak, McClelland, Maier & Neustadt, P.C.

(57) ABSTRACT

An embroidering system includes a central control device and a plurality of embroidering machines. The plural embroidering machines are synchronously operated by a command from the central control device. The central control device individually adjusts embroidering speeds of the plural embroidering machines.

7 Claims, 4 Drawing Sheets

EMBROIDERING SYSTEM

CROSS REFERENCE TO RELATED APPLICATIONS

This application is based on Japanese Patent Application No. 2002-344342, filed on Nov. 27, 2002, and is based on and claims priority under 35 U.S.C. § 119 to Japanese Patent Application 2004-040357, filed on Feb. 17, 2004, the entire contents of which are incorporated herein by reference.

FIELD OF THE INVENTION

This invention generally relates to an embroidering system. More particularly, the present invention pertains to an embroidering system including plural embroidering machines.

BACKGROUND

With known embroidering systems including plural embroidering machines, an operator has to initialize each embroidering machine in order to operate all the embroidering machines simultaneously. For more efficient operation, for example, a known embroidering system described in Japanese Patent Laid-Open Publication No. H06-304372 operates a first embroidering machine simultaneous with the other embroidering machines by allowing the first embroidering machine to memorize the information including the embroidering data and by transferring the memorized information to the other embroidering machines.

Notwithstanding, with the construction of the known embroidering system described in Japanese Patent Laid-Open Publication No. H06-304372, although the operational efficiency is increased for simultaneously embroidering the identical embroider pattern with the plural embroidering machines because the information is transferred from the first embroidering machine to the other embroidering machines, it is not practical for embroidering plural embroidering patterns with the plural embroidering machines.

Further, with the construction of the known embroidering system described in Japanese Patent Laid-Open Publication No. H06-304372, the minor errors between the embroidering machines are inevitable and thus the embroidering cannot be completed simultaneously at all embroidering machines even if the plural embroidering machines are started to operate simultaneously. In other words, because the timing for the completion of the embroidering is different depending on the embroidering machines, the operational efficiency is declined. More particularly, in case at least one of the embroidering machines is still operated, the embroidered products cannot be removed simultaneously, which significantly declines the operational efficiency.

A need thus exists for an embroidering system which completes the embroidering approximately simultaneously when the embroidery is performed with the plural embroidering machines synchronously.

SUMMARY OF THE INVENTION

In light of the foregoing, the present invention provides an embroidering system which includes a central control device, and a plurality of embroidering machines. The plural embroidering machines are synchronously operated by a command from the central control device. The central control device individually adjusts embroidering speeds of the plural embroidering machines.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
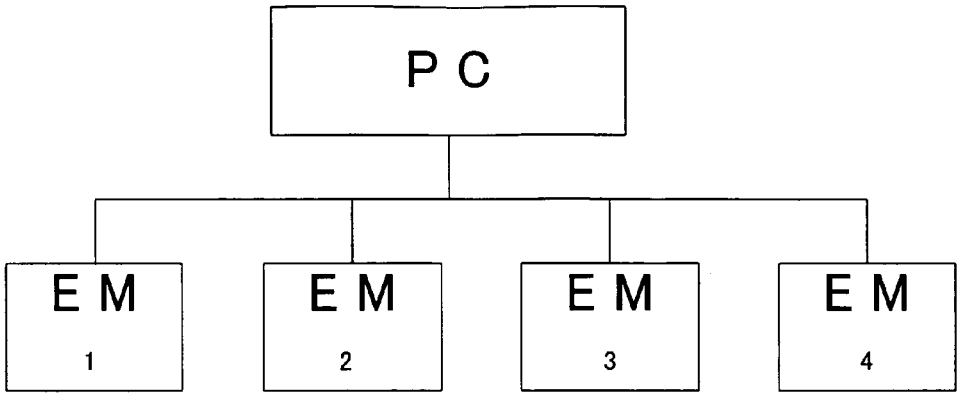
FIG. 1 shows a block diagram of an embroidering machine system according to a first embodiment of the present invention.

One embodiment of the present invention will be explained with reference to the illustrations of the drawing figures as follows.

As shown in FIG. 1, an embroidering machine system 10 includes a personal computer PC serving as a control device. The personal computer PC is connected to, for example, four embroidering machines EM. The four embroidering machines EM are simultaneously actuated by the embroidering data sent from the personal computer PC for forming a predetermined embroidering pattern with plural colors.

Figure 2:
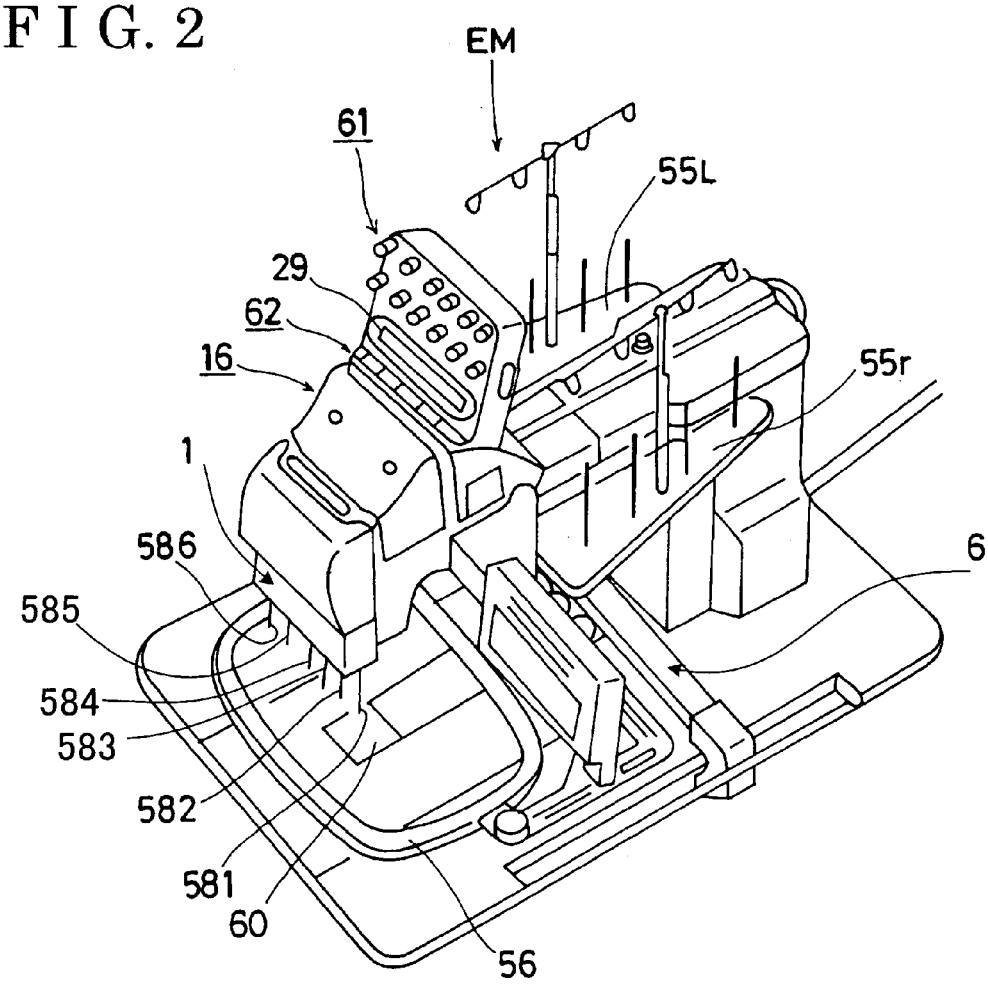
FIG. 2 shows a perspective view of an embroidering machine included in an embroidering system of FIG. 1.

As shown in FIG. 2, the embroidering machine EM includes an embroidery frame actuation device 6 for two-dimensionally actuating an embroidery frame 56 on a horizontal surface, a sewing mechanism 1 for actuating an embroidery needle provided over a needle piercing hole 60 in the upward and downward direction, and a needle selecting device 16 as described, for example, in Japanese Published Examined Application No. S53-43336 and Japanese Published Examined Application No. S55-8626.

With the construction of the first embodiment, because the needle selecting device 16 selectively sets one of needles 581–586 right above the needle piercing hole 60, the thread threaded at the needle positioned right above the needle piercing hole 60 is used for the embroidering.

An embroidering machine arm is provided with a bobbin table 55R and a bobbin table 55L for holding thread bobbins on the left and right sides of the embroidering arm. Four bobbins are always held at each bobbin table 55R, 55L. Threads wound around six bobbins out of eight bobbins in total are selectively threaded at the needles 581–586 through a tension 61, each hole of a thread guiding board 62, and a hole of a thread take-up lever.

The embroidering machine EM includes a control portion having a CPU as a primary part. When the embroidering data is sent from the personal computer PC to the control portion via an interface, the embroidering pattern with plural colors is embroidered on a cloth set at the embroidering frame 56 by the embroidering machine EM.

The embroidery sewing information of the several kinds of the embroidering patterns, in other words, the embroidering data, is written in a first embroidery device provided in the personal computer PC. The embroidering patterns are specified with unique names (i.e., file names). The embroidering sewing information of the file name of each pattern includes small number of management data and large number of stitch data. The management data includes the data indicating a predetermined thread color Ci and the thread color selecting order. The stitch data includes control data and frame actuation amount data. The control data includes thread change command data, end command data (i.e., the command data for completion of the embroidering), or the like. The frame actuation amount data shows a predetermined actuation amount (i.e., an X-axis moving amount and a Y-axis moving amount) from the last embroidery frame position (i.e., the last embroidering frame position is defined at a position where the center of the frame is positioned right above the needle piercing hole 60 at start). The stitch data includes the frame actuation amount data in order by one stitch unit when the thread is not changed and the embroidery is not completed. The thread change command data is inserted at the timing of changing the thread. The timing of the completion of the embroidering, that is, the end of the stitch data, corresponds to the end command data. With the thread color, RGB code is adopted.

The personal computer PC includes a second memory device. The second memory device is provided with the information of needle numbers N1–N6 provided at the six needles 581–586 of the embroidering machine EM and colors of the threads is supplied at the needles 581–586 as the pairs [Nj, Cj](j=1–6) via an input device such as a keyboard, a mouse, or the like in advance.

Figure 3:
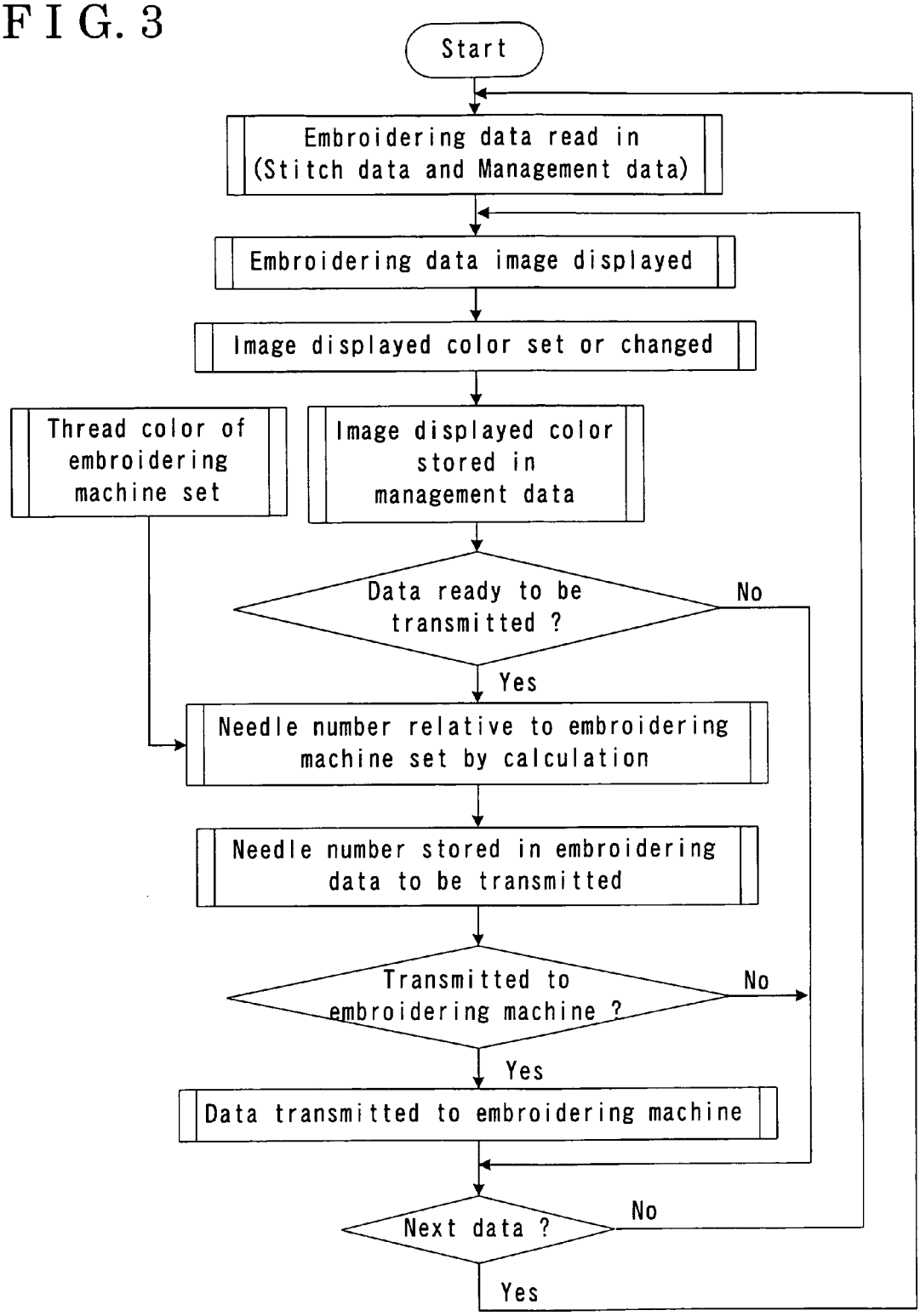
FIG. 3 is a flowchart showing the process for the preparation of the embroidering.

In order to produce the desired embroidering patterns with plural colors with the embroidering machines EM (1–4) by operating the embroidering machine system 10, the operation is prepared in the following process as shown in FIG. 3.

First, an image of the embroidering pattern with plural colors appears on a colored display. The pattern on the screen is shown with a line drawing showing threads with corresponding colors.

In order to replace the color for each thread, the operator selects the desired color from the color data chart displayed on the screen when clicking the corresponding line drawing. Thereafter, the content of the predetermined thread color Ci of the management data is amended to add the needle number Ni simultaneously in order to correspond to the selected color. In case the selected color is supplied at none of the needles, it is judged that the closest color is selected.

The embroidering data is transmitted from the personal computer PC to the CPU of the embroidering machine.

Each embroidering machine EM (1–4) individually includes an activation switch and a stop switch. The CPU of the personal computer PC always recognizes the state of the activation switch as the stop switch as an activation signal of the binary signal.

Figure 4:
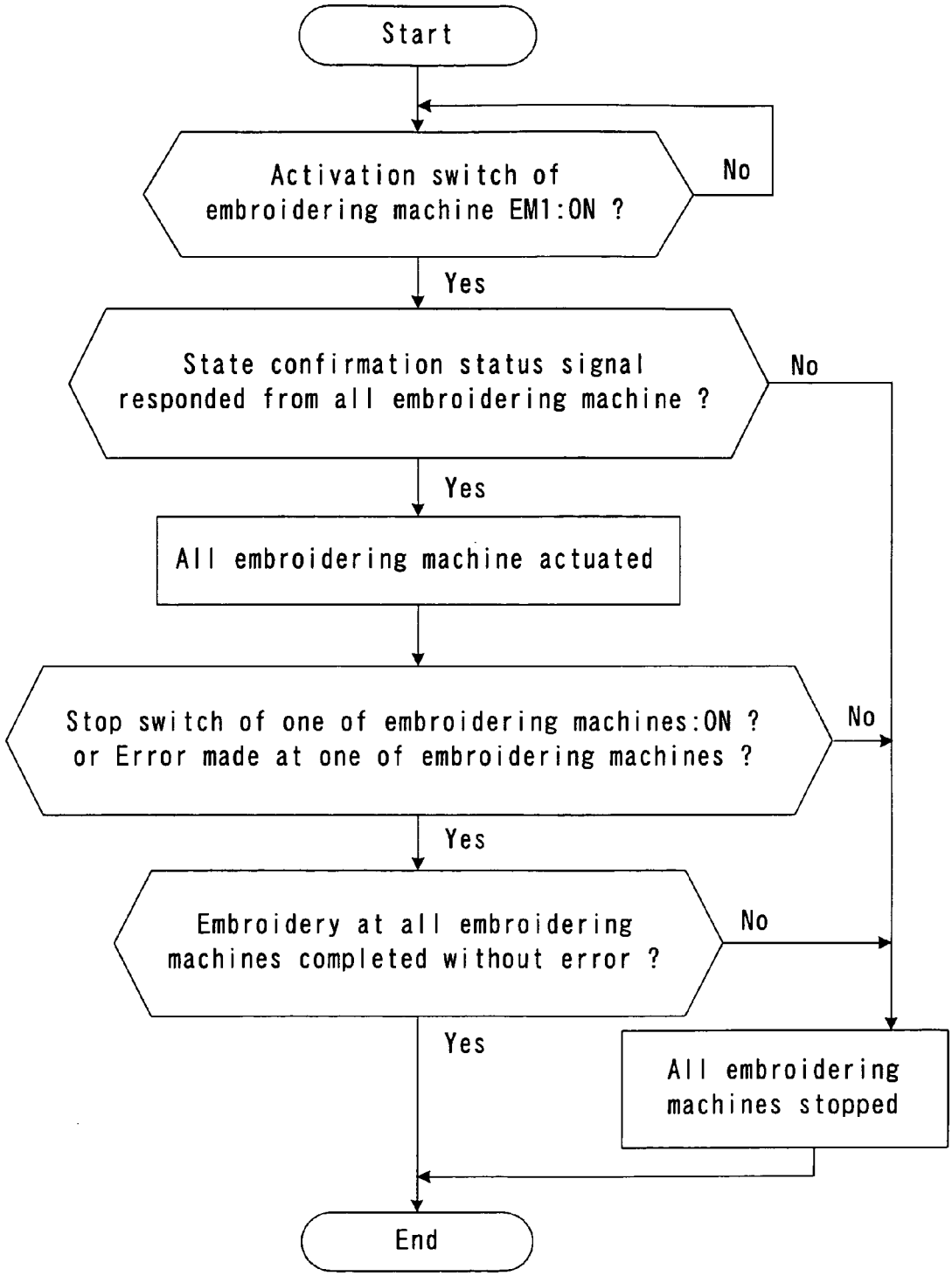
FIG. 4 is a flowchart showing the process for the embroidering.

The operation and the embroidering process by the embroidering machine system 10 is explained, for example, taking the case that the activation switch of the embroidering machine EM (1) is ON as shown in FIG. 4.

When the activation switch of the embroidering machine EM (1) is ON, the activation signal recognized by the CPU of the personal computer PC is switched from OFF to ON so that the CPU of the personal computer PC provides the command to the all embroidering machines EM (1–4) for requesting the response of the state confirmation signal. The embroidering machine EM which has completed the preparation operation responds to the CPU of the personal computer PC with the state confirmation status signal. In case at least one of the embroidering machines does not respond with the state confirmation status signal, the CPU of the persona computer PC indicates the relevant embroidering machine for urging the operator to prepare the operation of the embroidering machine. The CPU of the personal computer PC maintains the stopped state of the embroidering machine system 10 unless the preparation operation is completed for the embroidering machines which had not responded with the state confirmation status signal.

When the state confirmation status signal is responded from the all embroidering machines EM (1–4), the CPU of the personal computer PC actuates the all embroidering machines EM (1–4). Simultaneous with the response of the state confirmation status signal, the embroidery frame initial position coordinate signal is responded so that the CPU of the personal computer PC commands the embroidery frame to move to the initial position.

In case the stop switch of one of the embroidering machines is turned on to transmit the stop signal to the CPU of the personal computer PC or the error status signal is transmitted to the CPU of the personal computer PC from the embroidering machine having the error during the embroidering operation by the operation of the all embroidering machines EM (1–4), the CPU of the personal computer PC commands to stop the all embroidering machines EM (1–4).

In case at least one of the embroidering machines is stopped in accordance with the completion of the embroidering operation, the state of the other embroidering machines is maintained.

Each embroidering machine EM (1–4) includes a synchronous switch. For example, when the synchronous switch of the embroidering machine EM (2) is OFF, the command for requesting the response of the state confirmation signal is not provided from the CPU of the personal computer PC to the embroidering machine EM (2). In other words, the embroidering machine EM (1), the embroidering machine EM (3), and the embroidering machine EM (4) are synchronously actuated and the embroidering machine EM (2) is released from the synchronous actuation. Thus, the release of one of the embroidering machines, for example, the embroidering machine EM (2), from the synchronous actuation of the other embroidering machines, for example, the embroidering machine EM (1), the embroidering machine EM (3), and the embroidering machine EM (4) is advantageous for independently actuating the embroidering machine EM (2) and for actuating the other embroidering machines synchronously even when the embroidering machine EM (2) is out of order.

The switching between the synchronous operation and non-synchronous operation of the particular embroidering machine with the other embroidering machines may be set at the personal computer PC. The switching of the synchronous operation and the non-synchronous operation may be applied not only for the integral actuation but also for the particular operation (e.g., the start, the stop, the error stop, the initial setting of the frame position, or the like) and may be changed in accordance with the operational environment.

Although the foregoing processes are explained in case that the different embroidering patterns are embroidered with the embroidering machines EM (1–4), the same is applied when the embroidering machines EM (1–4) embroider the common pattern. In case the embroidering machines (1–4) embroider the common pattern at the embroidering system 10, the particular problem is raised, which is immediately solved as explained with reference to FIG. 5.

Figure 5:
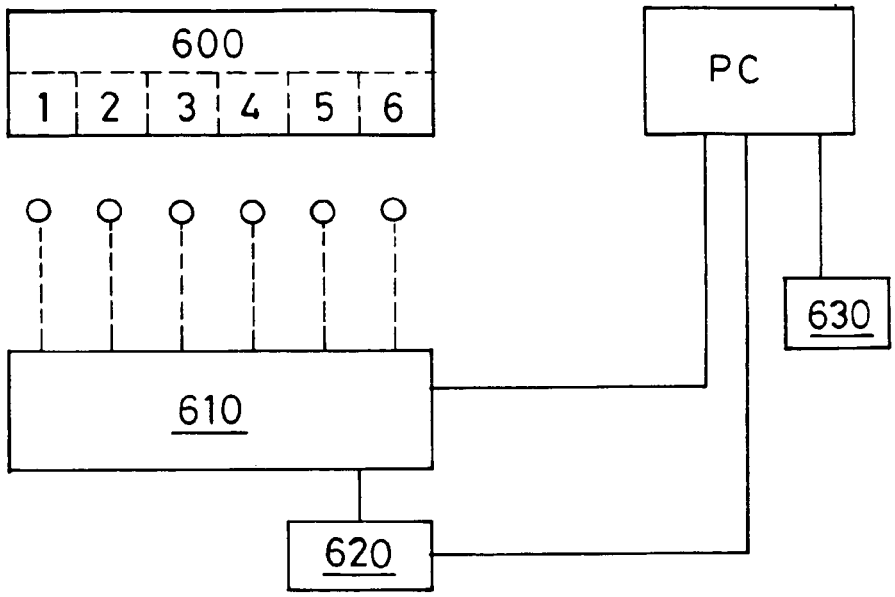
FIG. 5 is a block diagram showing other control systems according to the embroidering system of FIG. 1.

As shown in FIG. 5, the embroidering machine EM includes a stitch detection means 600 (1–6). The stitch detection means 600 (1), 600 (2), 600 (3), 600 (4), 600 (5), 600 (6) transmit the pulse signal to the CPU of the personal computer PC every upward and downward reciprocation of the needle 581, the needle 582, the needle 583, the needle 584, the needle 585, and the needle 586 respectively. Every time the pulse signal is transmitted to the CPU, a total stitch number counter adds by one. The value shown at the total stitch number counter corresponds to the stitch number for the embroidery from the start of the embroidering by the embroidering machine EM. The embroidering machine EM includes a speed sensor 620 and a timer 630 for detecting the rotational number of a common motor 610 for actuating the needle 581, the needle 582, the needle 583, the needle 584, the needle 585, and the needle 586. The speed sensor 620 always transmits the pulse signal showing the rotational number of the motor 610 to the CPU of the personal computer PC. In place of the plural stitch detection means, the rotational number of a sewing machine main shaft may be countered.

Figure 6:
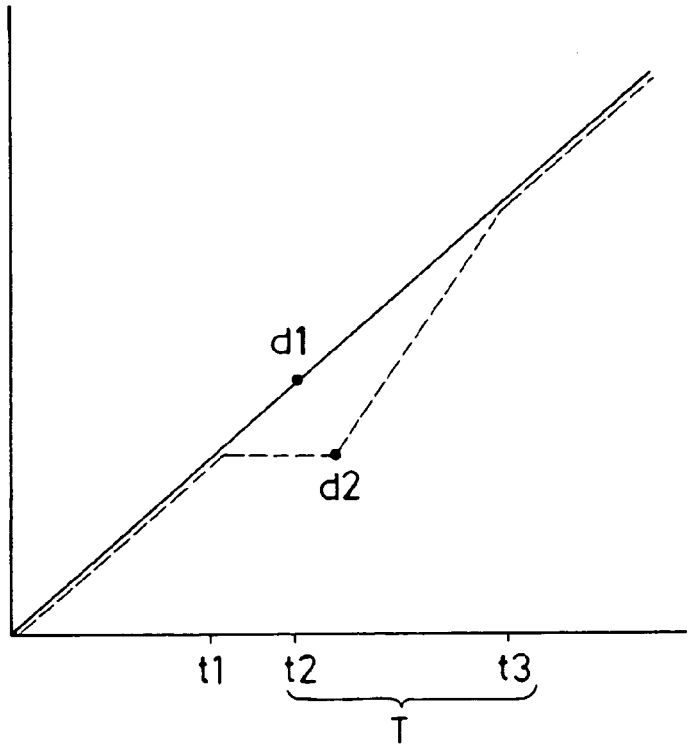
FIG. 6 is a graph used for explaining the operation of the other control systems shown in FIG. 5.

The stitch number is supposed to be always the same with the embroidering machines EM (1–6) in terms of the designing. However, the stitch number may be varied because of the manufacturing tolerance, or the like. With the embroidering machine system 10, even if the stitch number is varied depending on the embroidering machine, the variations are detected immediately to amend the stitch number to be the identical within a predetermined time. More particularly, as shown in FIG. 6, in case, for example, the embroidering machine EM (1) and the embroidering machine EM (2) are started simultaneously to have the stitch number d1 of the embroidering machine EM (1) and the stitch number d2 of the embroidering machine EM (2) the same up to a time t1 but the stitch number d2 assumes less than the stitch number d1 at a time t2 (i.e., for the explanatory purpose, the operation of the other embroidering machines is disregarded), the CPU commands to increase the rotational speed of the motor 610 (2) of the embroidering machine EM (2) (i.e., the embroidering speed of the embroidering machine EM(2)) within a predetermined time T so that the stitch number d1 and the stitch number d2 are equalized again (i.e., d1=d2). Defining the embroidering speed of the embroidering machine EM (1) and the embroidering speed of the embroidering machine EM (2) as V1, V2 respectively, the following formula is established.

$$V2=V1+(d1-d2)/T$$

Thus, the CPU commands to increase the rotational speed of the motor 610 (2) of the embroidering machine EM (2) within the predetermined time T until the embroidering speed V2 of the embroidering machine EM (2) attained from the formula is detected.

By performing the motor rotational number control every predetermined time, the stitch number d1 of the embroidering machine EM (1) and the stitch number d2 of the embroidering machine EM (2) can be maintained to be equalized, and thus the completion timing of the embroidering of the embroidering machine EM (1) and the embroidering machine EM (2) can be equalized.

According to the embroidering system of the embodiment, the efficient sewing operation can be achieved because the plural patterns or the single pattern can be synchronously embroidered with the plural embroidering machines. Further, the synchronous operation is always achieved because the other embroidering machines do not operate when one of the embroidering machines is not at the operation.

According to the embroidering system of the embodiment, the particular embroidering machine can be released from the synchronous actuation of the plural embroidering machines. This is advantageous for the individual actuation of the particular embroidering machine and the non-operation of the particular embroidering machine due to the failure.

According to the embroidering system of the embodiment, the embroidering by the plural embroidering machines actuated synchronously can be completed approximately simultaneously.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An embroidering system comprising:

a central control device;

a plurality of embroidering machines being operable in stand-alone mode; wherein the central control device synchronously operates the plural embroidering machines in response to both (i) confirming the operable state of the plural embroidering machines and (ii) the central control device detecting that at least one of the plural embroidering machines is manipulated to operate after embroidering data has been transferred from the central control device to the plural embroidering machines.

2. The embroidering system according to claim 1, wherein the central control device stops all embroidering machines when at least one of the plural embroidering machines is operated to be stopped or stopped due to abnormality.

3. The embroidering system according to claim 1, wherein each of the plural embroidering machines is configured to be released from the synchronous operation.

4. The embroidering system according to claim 3, wherein each of the plural embroidering machines is released from being synchronously operated when a synchronous switch which is provided in each of the plural embroidering machines is turned off.

5. The embroidering system according to claim 3, wherein each of the plural embroidering machines is released from being synchronously operated by manipulation of the central control device.

6. The embroidering system according to claim 1, wherein the central control device drives the plural embroidering machines at a same speed.

7. The embroidering system according to claim 1, wherein the plural embroidering machines are configured to operate at different speeds when synchronously operated, and wherein, even if one of the plural embroidering machines ceases to operate, the other embroidering machines continue to operate.

* * * * *